US005249855A

United States Patent [19]

Franklin et al.

[11] Patent Number: 5,249,855

[45] Date of Patent: Oct. 5, 1993

[54] SLIDE/SWING SECURITY DOOR

[75] Inventors: Robert Franklin, Lake Hopatcong; John La Rocca, Fairfield, both of N.J.

[73] Assignee: Trans World Marketing, East Rutherford, N.J.

[21] Appl. No.: 760,596

[22] Filed: Sep. 16, 1991

[51] Int. Cl.[5] ..... A47F 3/00

[52] U.S. Cl. ..... 312/138.1; 312/139.2; 49/255; 16/243

[58] Field of Search ..... 312/35, 139.1, 139.2, 312/138.1, 322, 326, 329; 49/254, 255; 16/243, 248, 362

[56] References Cited

U.S. PATENT DOCUMENTS

| | | | |
|---|---|---|---|
| 1,631,527 | 6/1927 | Heinz | 16/362 X |
| 2,069,232 | 2/1937 | Fitch | 49/254 |
| 2,104,430 | 1/1938 | MacEvoy | 16/362 X |
| 4,007,853 | 2/1977 | Bahneman | 312/42 X |
| 4,915,460 | 4/1990 | Nook et al. | 312/138.1 |

*Primary Examiner*—Kenneth J. Dorner
*Assistant Examiner*—Brian K. Green
*Attorney, Agent, or Firm*—Ostrolenk, Faber, Gerb & Soffen

[57] ABSTRACT

A dispensing-type display cabinet includes a frame and a door which is mounted to the frame such that the door is pivotally movable toward and away from the cabinet frame and is also vertically slidable. The cabinet frame includes a plurality of horizontal shelves for receiving product to be displayed and dispensed, and the door includes a plurality of vertically extending spaced partitions which define dispensing slits therebetween equal in number to the number of shelves. The door is vertically slidable between a position in which the slits are aligned with corresponding shelves so that product may be dispensed to a position in which the slits are not aligned with the shelves and product is inaccessible.

9 Claims, 4 Drawing Sheets

FIG. 5.
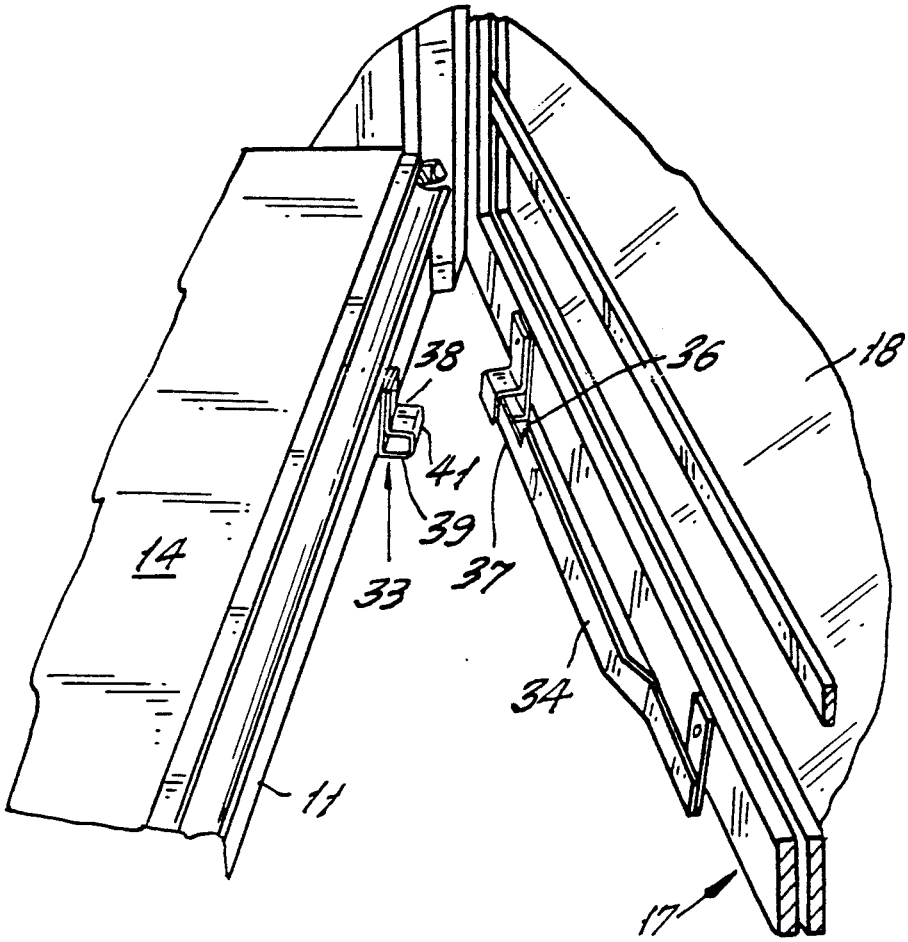
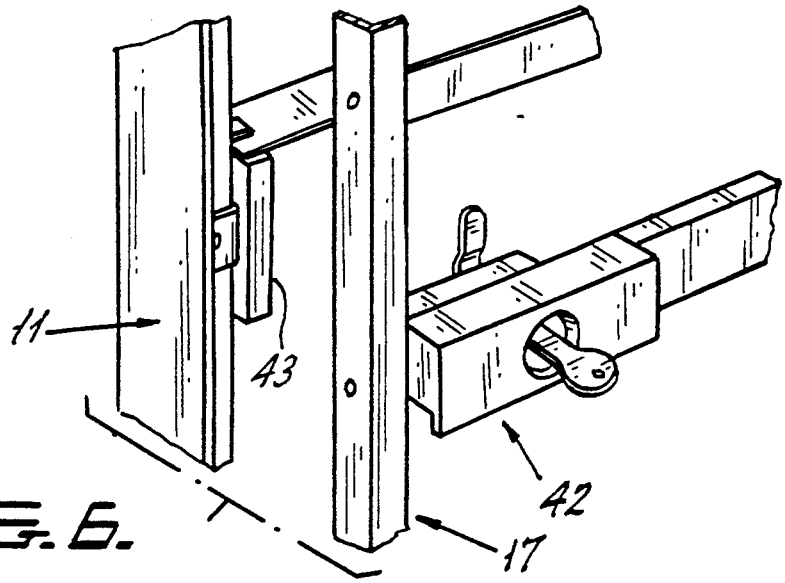
FIG. 6.

SLIDE/SWING SECURITY DOOR

BACKGROUND OF THE INVENTION

The present invention relates to dispensing-type display cabinets and, more particularly, relates to such a cabinet in which the dispensing function may be secured without interfering with the display function.

The prior art has provided many types of display cabinets having slit-like openings through which articles stored within compartments of the cabinet may be removed. Locking devices are often provided to prevent or secure the dispensing function, for example, at night, when the premises on which the cabinet is located are left unattended. Cabinets of this type are often multi-compartmented with an individual dispensing slit being provided for each compartment and with individual transparent doors being provided for each compartment. The doors are individually openable to facilitate stocking of the compartments. For the most part, prior art cabinets having individual doors for each compartment require individual locking devices for each door, or utilize locking bars that interfere with the display function and/or must be removed in order not to interfere with the dispensing function.

SUMMARY OF THE INVENTION

Accordingly, the primary object of the present invention is to provide a dispensing-type display cabinet having relatively inexpensive, reliable means for selectively securing the dispensing function.

Another object is to provide a display cabinet of this type in which the securing means does not interfere with either the display function or the dispensing function.

Still another object is to provide a display cabinet of this type in which the elements of the securing means remain mounted to the cabinet when they are not performing a securing function.

Still another object is to provide a display cabinet of this type in which only a single lock is required.

These and other objects are accomplished in accordance with the present invention by a cabinet which includes a frame and a door mounted to the frame so as to be both pivotable and vertically movable.

Advantageously, the frame includes one or more horizontal shelves for receiving a product to be displayed and dispensed, and the door includes a plurality of transverse partitions, generally of a transparent material, which are spaced so as to define dispensing slits equal in number to the number of shelves. The door is vertically movable from a position in which the slits are aligned with the shelves to enable a product to be dispensed therefrom to a position in which the slits are not aligned with the shelves so that the product is non-accessible and the dispensing function is thereby secured.

Other objects, features and advantages of the present invention will become apparent from the following description of the invention which refers to the accompanying drawings.

BRIEF DESCRIPTION OF THE DRAWINGS

FIG. 5 is a fragmentary, perspective view showing a shoe on the bottom of the cabinet frame and a cooperating spring on the door of the cabinet.

FIG. 6 is a fragmentary, perspective view showing a lock on the door of the cabinet and a strike on the frame.

DESCRIPTION OF A PREFERRED EMBODIMENT

Figure 1:
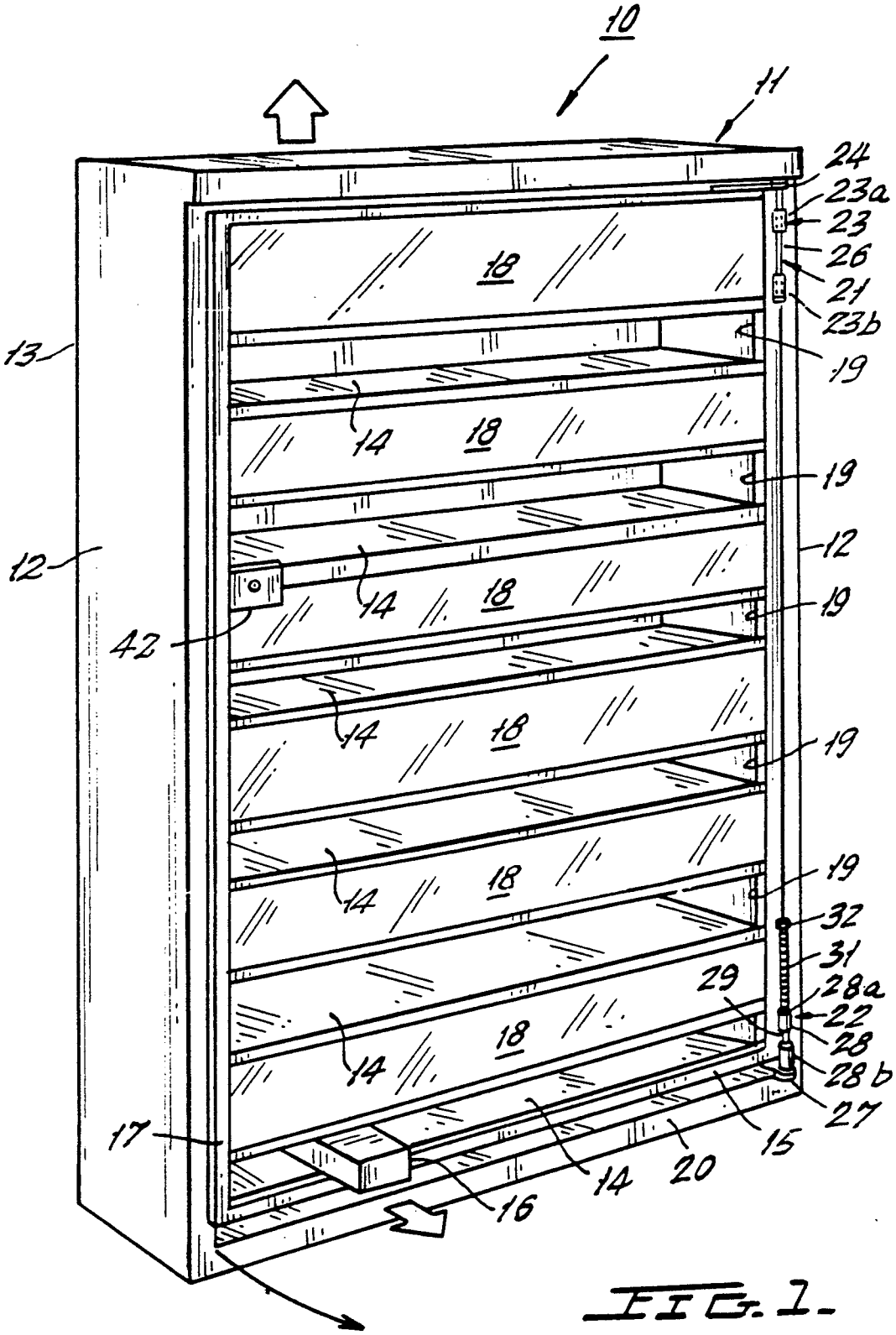
FIG. 1 is a perspective view of a dispensing-type display cabinet, illustrating certain principles of the present invention, with the cabinet shown in a product dispensing position.
Figure 2:
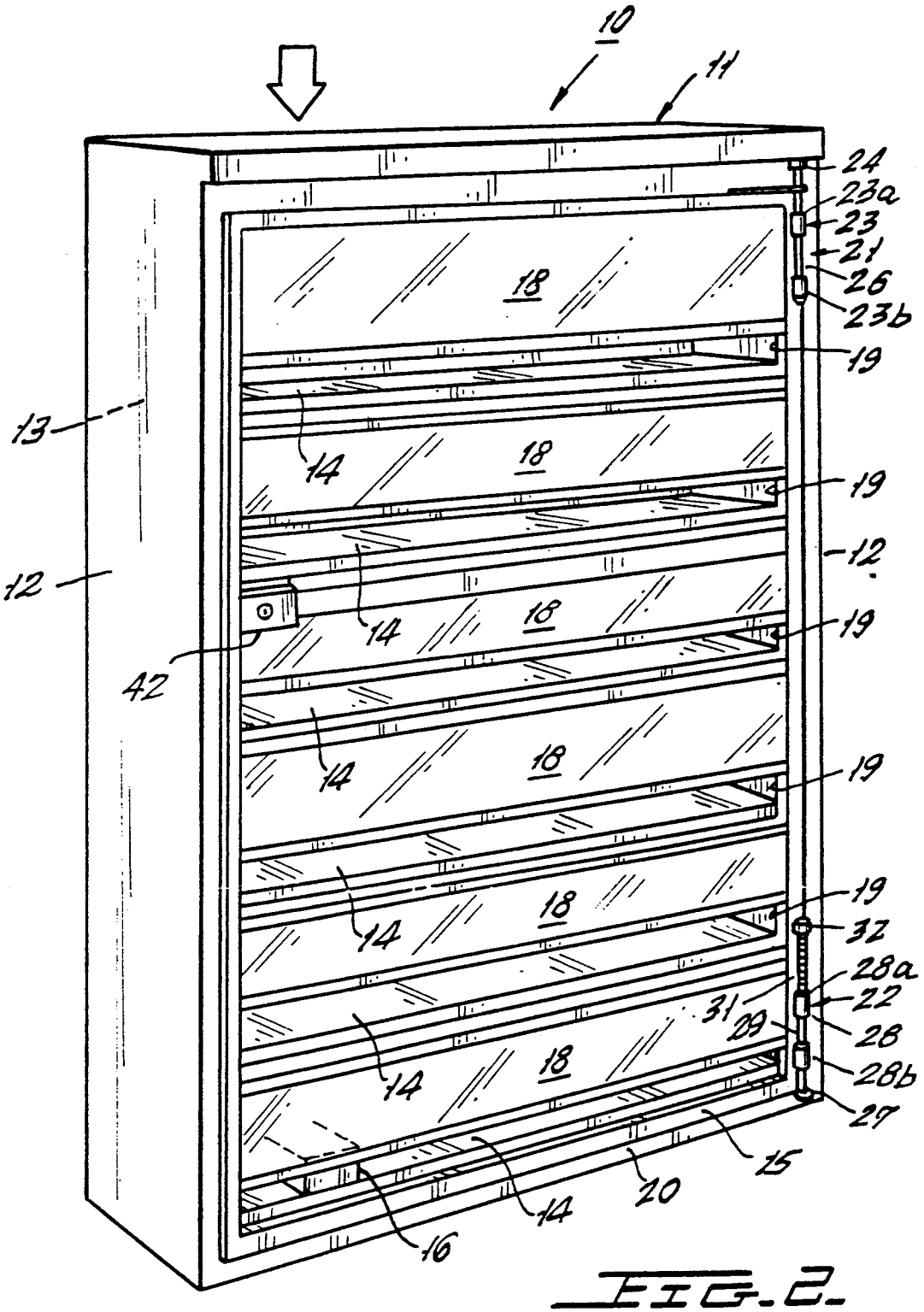
FIG. 2 is a perspective view of the cabinet of FIG. 1 showing the cabinet in a non-dispensing position.

Referring now to the drawings and, in particular, to FIGS. 1 and 2, there is shown a dispensing-type display cabinet 10 in accordance with the present invention. The cabinet 10 includes a generally rectangular frame 11 having side walls 12 that extend forward from a rear wall 13 to define a front opening of the cabinet. A plurality of horizontal shelves 14 for receiving units 16 of product to be displayed and dispensed extend between the side walls 12. The shelves 14 divide the interior of the cabinet 10 into a number of compartments, six in the embodiment shown in FIGS. 1 and 2, disposed one above the other.

The front of the cabinet 10 is closable by a door 17 which has a width coextensive with the width of the cabinet frame 11 and which includes a plurality of spaced vertical partitions 18 extending across the width of the door. The partitions 18 are made of a transparent material and are spaced from each other such as to define a plurality of dispensing slits 19 equal in number to the number of shelves 14, six in the illustrated embodiment. The height of each slit 19 is at least equal to that of a product unit 16.

As will be hereinafter described in more detail, the door 17 is mounted so that it is both pivotal towards and away from the cabinet frame 11 and is vertically slidable between a raised or dispensing position (the position shown in FIG. 1) and a lowered or non-dispensing position (the position shown in FIG. 2). Pivoting of the door 17 enables the door to be swung away from the frame to gain access to the interior so that the shelves may be stocked with product units 16. When the door 17 is pivoted towards the frame and closed, the product units 16 may only be removed when the slits 19 in the door are aligned with respective shelves 14. This is done by sliding the door 17 to its raised or product dispensing position (the position shown in FIG. 1). The movement of the door 17 to its raised position can be noted by the difference in height between the bottom 15 of the door and the lower portion of the frame 20. When the door is in its lowered or non-dispensing position (the position shown in FIG. 2), the slits 19 are non-aligned with the shelves 14 and there is no access to the product within the cabinet. It should be noted that in the lowered or product blocking position, the slits 19 do not have to be completely non-aligned with their respective shelves. It is sufficient that the door 17 be moved a distance such that the height of each dispensing slit is effectively narrowed so that it is less than the height of a product unit 16.

Figure 3:
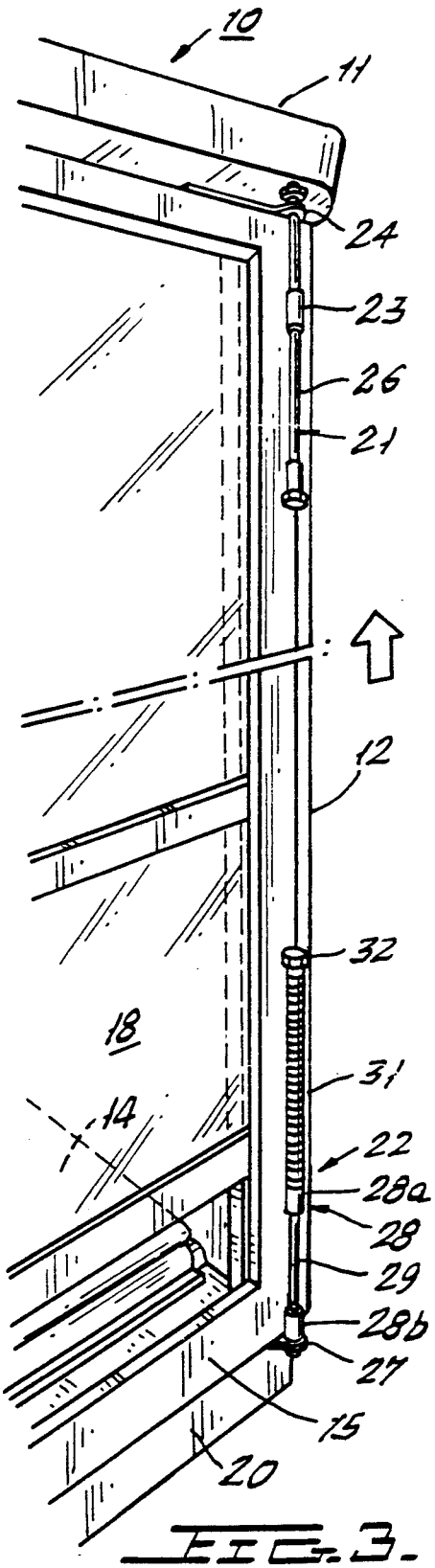
FIG. 3 is a fragmentary elevation view of the dispensing-type display cabinet showing the manner in which a door of the cabinet is mounted to a cabinet frame with the door being in its product dispensing position.
Figure 4:
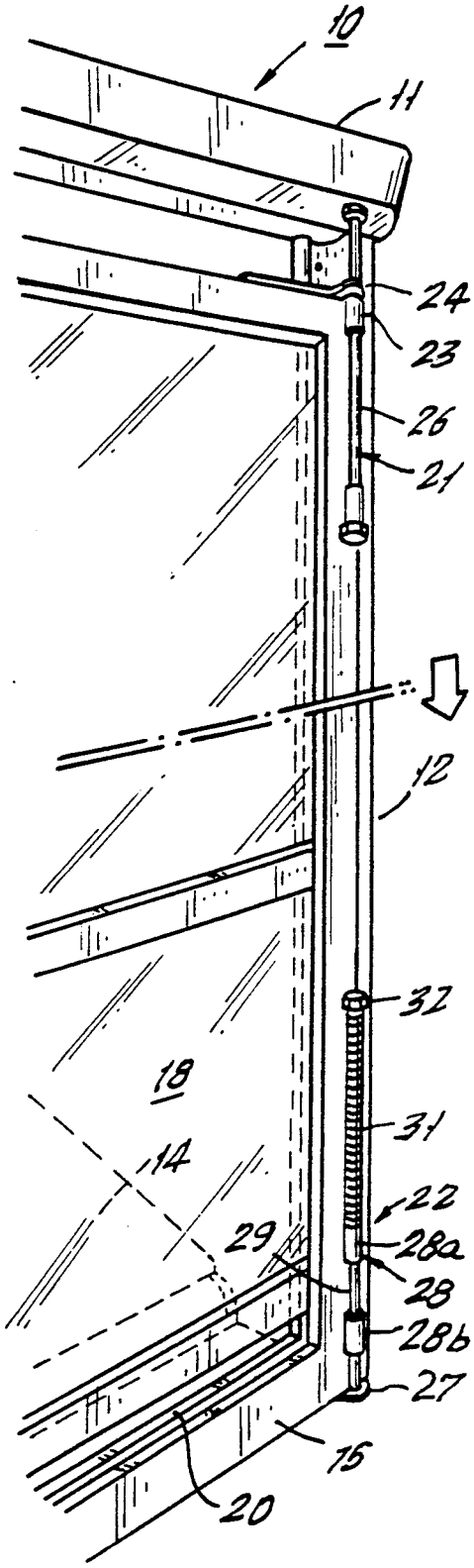
FIG. 4 is a view similar to FIG. 3 showing the door in its non-product dispensing position.

Referring now to FIGS. 3 and 4, the door is mounted to the cabinet frame by means of a sliding hinge 21 at the top and a sliding hinge 22 at the bottom. The top hinge 21 includes a butt-type hinge component 23 secured to the right side wall 12 of the cabinet frame, as viewed in FIGS. 1 and 2, by suitable fasteners (not shown), and a pivot-type hinge component 24 secured to the door by suitable fasteners (not shown). The two hinge components 23 and 24 are interconnected by a common pin 26, with the hinge component 23 having knuckles 23*a* and 23*b* and being vertically spaced from the hinge component 24 such that the hinge component 24 may slide over the pin relative to the hinge component 23 from the raised position shown in FIG. 3 to the lowered position shown in FIG. 4. The pin 26 is substantially longer than the height of the hinge component 23 so as to accommodate the necessary vertical movement.

At the bottom, the bottom sliding hinge 22 includes a pivot-type hinge component 27 similar to the hinge component 23, the hinge component 27 being mounted to the door by suitable fasteners (not shown), and a butt-type hinge component 28 similar to the hinge component 24, which has knuckles 28*a* and 28*b*, and, the hinge component 28 being mounted to the frame by suitable fasteners (not shown). Like the hinge components 23 and 24, the hinge components 27 and 28 are vertically spaced from each other and interconnected by an extra long pin 29. In the case of the bottom hinge 22, a compression spring 31 is further provided between the head 32 of the pin 29 and the hinge component 28 to act as a counterbalance to the weight of the door 17. More specifically, when the door 17 is lowered, the spring 31 is compressed thereby counter-balancing the weight of the door.

Referring now to FIG. 5, the frame 11 at the bottom thereof includes a projecting shoe 33 which is suitable fastened thereto and which serves to support the door 17 when the door is in the raised position. For this purpose, the door includes at its bottom a horizontally extending member 34 which is cutout in the portion facing the shoe to form a reduced section 36. In the raised position of the door 17, the lower edge 37 of the reduced section 36 rests on the top 38 of the shoe 33, while in the lower position the reduced section 36 fits beneath the lower edge 39 of the shoe 33 so that the door 17 may be tightly engaged with the frame 11. Preferably, the member 34 is made of a spring-like material so as to cushion the impact if the door 17 is inadvertently closed when it is in a position intermediate the raised and lower positions, i.e., in that case the reduced section 36 will engage the front face 41 of the shoe 33 and absorb the force of impact.

The door also includes a key-operated lock 42 (FIG. 6) which cooperates with a strike 43 suitably mounted on the frame 11 so that the door 17 may be locked in its lower position.

The operation of the cabinet 10 will now be described. With the lock 42 in its open position, the door 17 is pivoted or swung away from the frame 11. This enables access to the interior of the cabinet and allows the shelves 14 to be stocked with product units 16. It should be noted that when the door 17 is swung away from the cabinet frame 11, the weight of the door moves the door to its lower position thereby compressing the spring 31. More specifically, the weight of the door 17 acting through the head 32 of the pin 29 compresses the spring 31 between the head 32 and the hinge component 28. After the product units 16 are stocked on the shelves 14, the door 17 is swung inward to its closed position and vertically moved upwardly to its raised position, the spring 31 assisting such vertical movement so that the attendant is not required to lift the full weight of the door. In its raised position (FIG. 1), each of the slits 19 is aligned with a corresponding shelf 14 so that a product unit 16 may easily be removed from the shelf. When it is desired to secure the cabinet 10, such as, for example, at night, so that no product unit 16 is accessible, the door 17 is swung away slightly, the door dropping to its lower position. Then the door 17 is swung inwardly again, and the lock 42 actuated to lock the cabinet 10. In this lowered position, as seen in FIG. 2, the height of the opening adjacent each shelf 14 is such that no product unit 16 may be removed from a shelf.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A cabinet comprising:

a) a frame having a vertical rear wall, vertical side walls extending forward from opposite edges of said rear wall and defining an open-front and at least one shelf extending between the side walls for receiving a product;

b) a door for closing the open-front of the frame, the door including at least first and second members extending horizontally across the door, the first and second members defining an open space therebetween; and c) means for mounting the door to the frame such that the door is both vertically movable with respect to the frame and pivotable about a vertical axis towards and away from the frame, the door being vertically movable from a position in which the open space is aligned with the shelf to enable access to the product and a position in which the open space is not aligned with the shelf so that the product is inaccessible.

2. A cabinet comprising:

a) a frame having a vertical rear wall and vertical side walls extending forward from opposite edges of said rear wall and defining an open-front;

b) a plurality of shelves extending horizontally between the side walls of the frame for receiving product thereon;

c) a door for closing the open-front of the frame, the door including a plurality of spaced transverse members extending horizontally across the door and defining a plurality of slits equal in number to the number of shelves; and d) means for mounting the door to the frame such that the door is both vertically movable with respect to the frame and pivotable towards and away from the frame, the door being vertically movable from a first position in which each of the slits is aligned with one of the shelves so as to enable access to product placed on the shelves, to a second position in which the slits are not aligned and the product on the shelves is inaccessible.

3. A cabinet as defined in claim 2, in which the mounting means comprises a slidable hinge including a first hinge component mounted on the frame, a second hinge component mounted on the door and a pin interconnecting the first and second hinge components.

4. A cabinet as in claim 3, further comprising a compression spring mounted on the pin to counter-balance the weight of the door.

5. A cabinet as defined in claim 2, in which the mounting means comprises top and bottom spaced sliding hinges, each hinge including a first hinge component mounted on the frame, a second hinge component mounted on the door and a pin interconnecting the first and second hinge components.

6. A cabinet as defined in claim 5, in which the first hinge component is a pivot-type hinge component and the second hinge component is a butt-type hinge component.

7. A cabinet as defined in claim 6, further comprising a head on the pin of the bottom sliding hinge and a compression spring mounted on the pin of the bottom sliding hinge between the head thereof and the second hinge component of the bottom sliding hinge.

8. A cabinet as defined in claim 7, wherein the frame includes a horizontally extending base and further including a shoe projecting towards the door from the base, the door having a horizontally extending member for engagement with the shoe when the door is in its first position so as to maintain the door in said first position.

9. A cabinet as defined in claim 8, in which the horizontally extending member includes a horizontal spring having a cutout such that member may fit beneath the shoe when the door is said second position.

* * * * *